United States Patent [19]

Iwao et al.

[11] Patent Number: 4,483,249

[45] **Date of Patent: * Nov. 20, 1984**

[54] HAMMER LOCK RELEASING MECHANISM FOR A PRINTING DEVICE

[75] Inventors: Takayuki Iwao, Chofu; Takemitsu Ono, Machida; Yukio Ishikawa, Yamato, all of Japan

[73] Assignee: Mitsumi Electric Co., Ltd., Tokyo, Japan

[ * ] Notice: The portion of the term of this patent subsequent to Apr. 27, 1999 has been disclaimed.

[21] Appl. No.: 296,963

[22] Filed: Sep. 25, 1981

Related U.S. Application Data

[62] Division of Ser. No. 87,956, Oct. 24, 1979, Pat. No. 4,326,459.

[30] Foreign Application Priority Data

Jan. 25, 1979 [JP] Japan ..... 54-8067[U]

[51] Int. Cl.[3] ..... B41J 9/28

[52] U.S. Cl. ..... 101/93.30

[58] Field of Search ..... 101/93.29, 93.30, 93.31, 101/93.28, 93.33, 93.34; 74/567

[56] References Cited

U.S. PATENT DOCUMENTS

| | | | |
|---|---|---|---|
| 1,705,803 | 3/1929 | Brush et al. | 74/567 |
| 3,848,527 | 11/1974 | Nihira | 101/93.23 |
| 4,326,459 | 4/1982 | Iwao et al. | 101/93.30 |

FOREIGN PATENT DOCUMENTS

| | | |
|---|---|---|
| 1247712 | 8/1967 | Fed. Rep. of Germany . |
| 2234702 | 2/1973 | Fed. Rep. of Germany . |
| 2322285 | 11/1973 | Fed. Rep. of Germany . |
| 54-128508 | 9/1979 | Japan . |

*Primary Examiner*—Edgar S. Burr
*Assistant Examiner*—David A. Wiecking
*Attorney, Agent, or Firm*—Michael N. Meller

[57] ABSTRACT

A printing device comprises a rotary type wheel provided on its outer surface with a plurality of types disposed at equal angular intervals and in at least one column, a printing hammer head disposed confronting said type wheel and undergoing displacement, in printing operation, to strike a desired type selectively onto a sheet of paper thereby to carry out printing, means for urging the hammer head to move in the direction of carrying out printing action, a mechanism for locking the hammer head in a non-printing position, and a mechanism for releasing the hammer head from its locked state by means of the locking mechanism. The locking mechanism comprises a locking member for locking the hammer head and a first spring for urging the locking member so as to make locking operation. The releasing mechanism comprises a single electromagnet, a second spring facing the electromagnet in spaced-apart relation which is caused to displace when the electromagnet is operated, a locking member displacing together with the second spring, an unlocking cam rotating correspondingly with the rotation of the type wheel and engaging the engaging catch displaced to further move the engaging catch thereby to release the locked state of the hammer head locked by the locking member.

6 Claims, 14 Drawing Figures

INPUT
CONT CKT
RESET SIG DETEC
TIMING SIG DETEC
10
11
11a
11b
12
13
14
15
15a
16
17
17a
17b
17c
18
18a
18b
18c
18d
19
20a
20b
21
22
22a
22c
24
25
25a
26
26a
31
31a
32
33
34
36
37
37a
37b
37c
37d
38
39
40
101
102
103
104

HAMMER LOCK RELEASING MECHANISM FOR A PRINTING DEVICE

This is a division of application Ser. No. 087,956 filed Oct. 24, 1979 now U.S. Pat. No. 4,326,459.

BACKGROUND OF THE INVENTION

The present invention relates generally to printers or printing devices in which printing hammers stamp or strike against types over a sheet of paper thereby to carry out printing. More particularly, the invention relates to a printing device in which a hammer lock releasing mechanism for unlocking each printing hammer from its locked state thereby to permit its printing stroke is capable of carrying out unlocking and locking operations at high speed.

Heretofore, there has been a printer of a kind wherein, as seen in U.S. Pat. No. 3,848,527, a plurality of hammers are grouped into sets and, for each set, there are provided a mechanism for locking the hammers in non-printing positions, an electromagnet for unlocking the locking mechanism, and a roller having, for each hammer, a hammer rotation permitting part and a hammer resetting part. The hammer rotation permitting parts and hammer resetting parts of this roller are disposed at positions in the rotational direction differing from hammer to hammer. The hammers of each set are simultaneously released by the operation of the electromagnet from their locked states due to the locking mechanism, and, in accordance with the rotation of the roller, the hammers which are caused to confront the hammer rotation permitting parts of the roller are permitted to rotate thereby to print. In a printer of this character, there is no necessity of providing an electromagnet for each hammer, one electomagnet being sufficient for a plurality of hammers of each set, whereby the construction of the device becomes simple.

The locking mechanism in this known printer comprises an armature which engages one part of a rotating lever of each hammer and, when the electromagnet is energized, is attracted thereto thereby to rotate and a spring for urging this armature into the above mentioned locked state. The armature is attracted toward the electromagnet when it is energized and, overcoming the force of the spring, rotates to release the rotating lever of the hammer from its locked state. When the electromagnet is not being energized, the armature is rotated in the reverse direction by the force of the spring to engage the rotating lever and thereby to lock the hammer in its non-printing position.

In order to increase the return speed of the armature when the electromagnet is not being energized in this known printer for the purpose of speeding up the entire printing operation, the force of the return spring must be increased. However, when the force of the spring is increased, the size of the electromagnet for rotating the armature against this spring force must also be increased, and the electric power consumption also increases. On the other hand, when an electromagnet of low capacity is used in order to reduce the electric power consumption, the above mentioned force of the spring must be reduced in order obtain positive armature attracting operation. In this case, the return motion of the armature when the electromagnet is deenergized becomes slow, and the total result is that the printing speed cannot be increased.

SUMMARY OF THE INVENTION

Accordingly it is a general object of the present invention to provide a novel and useful printing device in which the above described problems have been overcome.

Another and specific object of the invention is to provide a printing device provided with a novel locking and unlocking mechanism for the hammer. According to the invention, this locking and unlocking mechanism comprises a locking member for locking each hammer, a first spring means for urging this locking member in the locking direction, an electromagnet, a second spring means urged in a direction away from this electromagnet and adapted to be attracted toward the electromagnet, an engaging member undergoing displacement unitarily with this second spring means, and a rotary cam operating after the second spring means is attracted and drawn by the electromagnet to engage the engaging member and cause it to undergo displacement in a direction to release the hammer from its locked state due to the locking member. In this mechanism, the spring force of the first spring means is made large, while that of the second spring means is selected at a small value.

In the printing device of the present invention, since the spring force of the first spring means is large, the return motion of the locking member for relocking after completion of the operation of unlocking of the hammer from the locking action of the locking member is rapid, and the printing operation time, as a whole, becomes short. Furthermore, since the spring force of the second spring means is small, the electromagnet for attracting and drawing this second spring means is not required to have a large attracting force, whereby an electromagnet of small size is sufficient. Moreover, since only a low energizing current is sufficient, the electric power consumption is low.

Still another object of the invention is to provide a printing device which has a resetting cam for permitting the typing operation of one hammer of the hammers of one set unlocked by the above mentioned unlocking mechanism and, after the printing operation, restoring the hammer to its original position, this resetting cam being so shaped that noise will not be generated between it and the hammer.

A further object of the invention is to provide a printing device in which hammers confront, in spaced-apart relation, almost the entire outer peripheral part of the resetting cam. By this feature, the resetting cam rotates with almost no friction due to the hammers, whereby the power required for driving the resetting cam is greatly reduced.

Other objects and further features of the invention will be apparent from the following detailed description with respect to preferred embodiments of the invention when read in conjunction with the accompanying drawings.

DETAILED DESCRIPTION

The general construction of the first embodiment of the printing device according to the present invention will first be described in conjunction with FIGS. 1 and 2.

Figure 3:
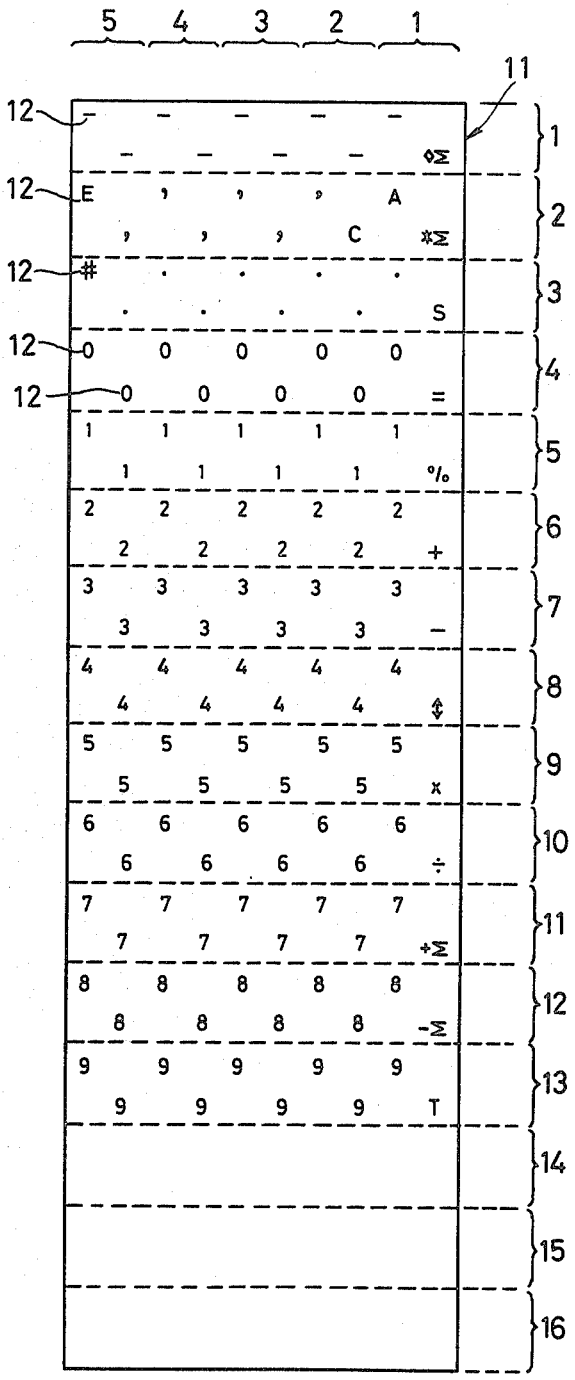
FIG. 3 is a development or expansion of a rotary type wheel of the same printing device.

This printing device, generally designated by the reference numeral 10, has a rotary type wheel 11 comprising a rotary drum or a rotary wheel. The type wheel 11 is driven in rotation in the arrow direction at a specific speed about a lateral shaft 11*b*. The type wheel 11 is provided on its cylindrical outer surface with types 12. As shown in FIG. 3, which is a dvelopment of the outer surface of the type wheel 11, the types 12 are disposed in columns, two adjacent columns, for example, consituting a set. In the example illustrated, there are a total of ten columns in five sets extending in the circumferential direction of the type wheel 11.

In each set, the type respectively in the two adjacent column are mutually staggered in pitch in the circumferential direction by the distance of one character. Furthermore, the types 12 are also disposed within 13 transverse divisions out of 16 equal divisions of the entire circumference of the type wheel 11, each division containing two adjacent rows of the types. The remaining three divisions are left blank for stopping of the feed and rising-up of moving of the printing paper 38. All types 12 are supplied with printing ink by an ink roller 13 pressed parallelly against and rotating with the type wheel 11.

Figures 1, 4:
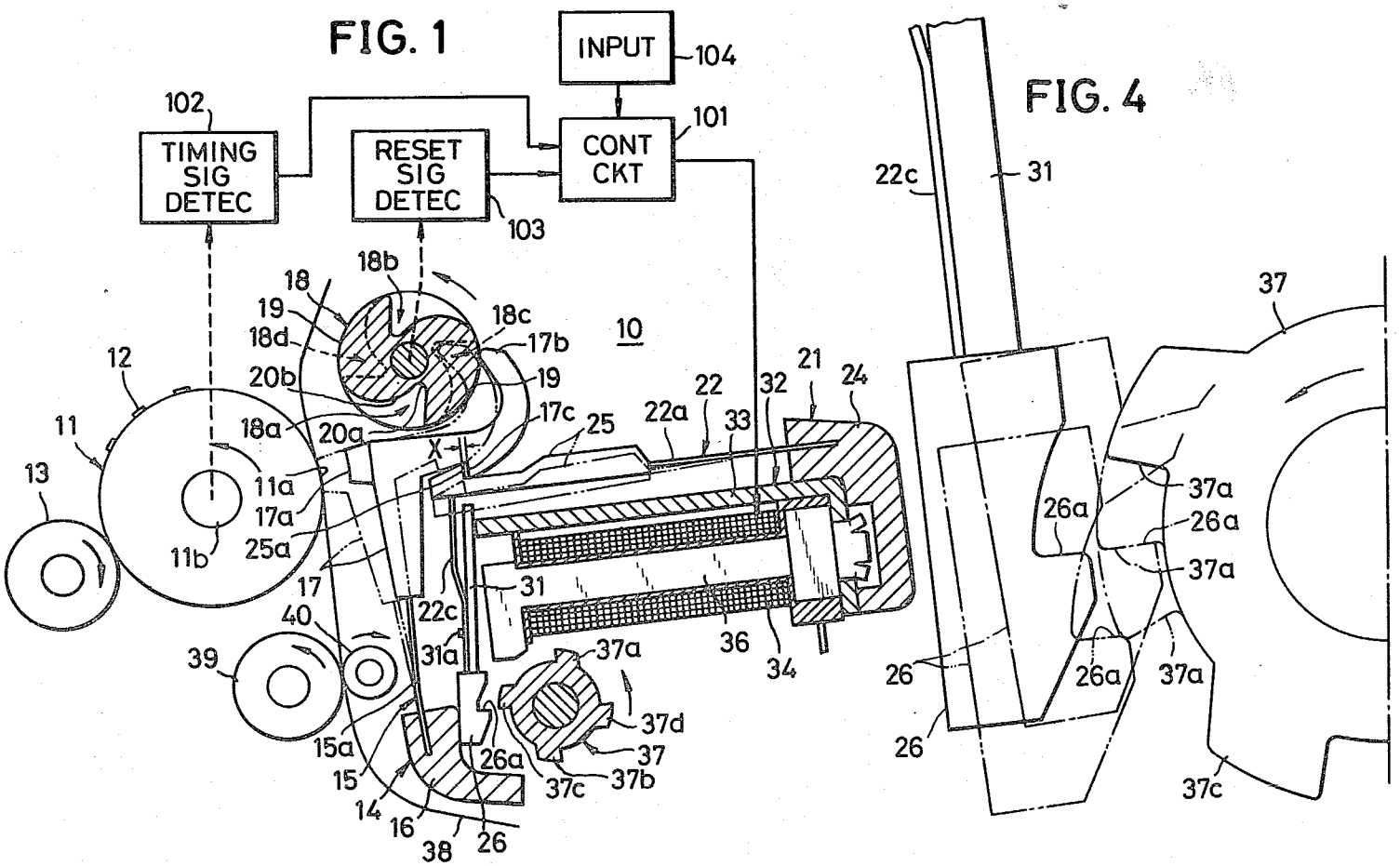
FIG. 1 is a side elevation, with parts cut away and parts shown in section, of a first embodiment of a printing device according to the present invention.
FIG. 4 is a relatively enlarged, fragmentary side elevation indicating the engagement action of a second engaging part and an unlocking cam of an engagement member of the same printing device.
Figure 2:
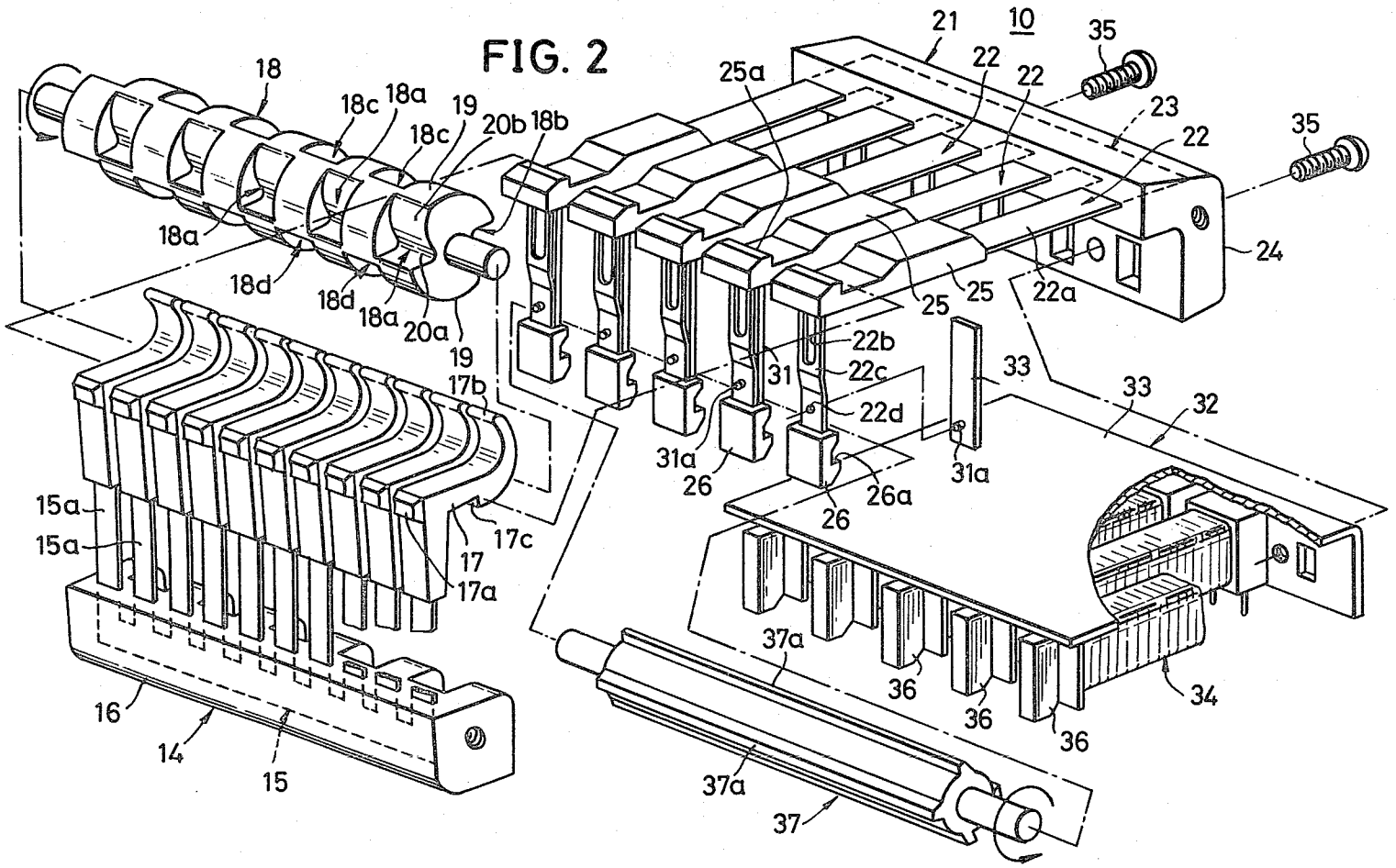
FIG. 2 is an exploded perspective view of the printing device shown in FIG. 1.

The printing device 10 also has a hammer block 14 comprising, as shown in FIGS. 1 and 2, a comb-shaped leaf spring 15 having as its teeth, for example, 10 hammer springs 15*a* for 10 columns, a horizontal base 16 made of synthetic resin in which the back part of the comb-shaped leaf spring 15 is embedded, and 10 hammer heads 17 for 10 columns respectively mounted on the free ends of the hammer springs 15*a*, the entire hammer block 14 being integrally mold formed. Each hammer head 17 has a striking face 17*a*, a curved convex part 17*b* for resetting, and a recess 17*c* with a ledge for engagement. As shown in FIG. 1, the hammer block 14 is so disposed that the striking faces 17*a* of the hammer heads 17 are facing but spaced apart from the printing position 11*a* of the type wheel 11 opposite respective columns of types 12.

Above the row of hammer heads 17, is provided a roller-shaped resetting cam structure 18 supported to rotate about a lateral axis by a structural part of the printing device. In the illustrated example, this resetting cam structure 18 is adapted to be driven in rotation correspondingly with the rotation of the type wheel 11 at a rate of ½ revolution for every rotation of the type wheel 11 through an angle corresponding to the pitch of one type character in its circumferential direction.

The resetting cam structure 18 is provided along its axial direction with a total of five sets of recesses, each set corresponding to two of the aforedescribed columns. These recess sets respectively comprise a pair of diametrically opposed recesses 18*a* and 18*b* and a pair of like recesses 18*c* and 18*d* in alternate disposition in the cam axial direction. The recesses of adjacent sets are angularly staggered in phase by 90 degrees. At each recess set part of the resetting cam structure 18, the pair of outer peripheral engaging parts 19 formed by and between the recesses 18*a* and 18*b* (or 18*c* and 18*d*) are respectively slidingly contacted by the convex parts of the corresponding hammer heads 17 as described hereinafter and hold these hammer heads 17 in a stand-by or preparatory position. At this time, the leaf spring 17 has passed its spring neutral point and is deflected toward the right as viewed in FIG. 1. Furthermore, each of the recesses 18*a* through 18*d* comprises a concave part 20*a* for permitting rotation for the printing action of the corresponding hammer heads 17 and a resetting part 20*b* for smoothly joining the engaging parts 19 and rotation permitting part 20*a*.

An engagement mechanism generally designated by reference numeral 21 is provided to operate cooperatively with the resetting cam structure 18 and comprises a comb-shaped leaf spring 23 having a total of five teeth in the form of L-shaped leaf spring parts 22 for 10 columns, two columns constituting one set, a base 24 made of synthetic resin in which the back of the comb-shaped leaf spring 23 is embedded, and first and second engaging catches 25 and 26 made of synthetic resin and mounted on each leaf spring part 22, these component parts of the engagement mechanism 21 being integrally mold formed. At this time, each first engaging catch 25 is supported by a part 22*a* of relatively large spring force of the spring part 22 in a state wherein the catch 25 is elastically rotatable about the root part of the part 22*a* at its juncture with the base 24. Each second engaging catch 26 is supported by a spring part 22*c* of relatively small spring force provided with an opening 22*b* in a state wherein it is elastically rotatable about the juncture between the spring part 22*c* and the first catch 25. In the present embodiment of the invention, the leaf spring part 22 has spring parts 22*a* and 22*c* integrally formed therewith and has a substantially L-shaped form in side view, but the spring parts 22a 22c may be constructed as separate structures.

An armature 31 has a stud pin 31a which is inserted in a hole 22d of a corresponding one of the spring parts 22c thereby fixedly securing the armature 31 to the spring part 22c. At this time, a catch ledge 25a of each first engaging catch 25 is engaged with the recess 17c of the corresponding hammer heads 17 of two columns as shown in FIG. 1 and thereby holds the hammer heads 17 of two columns in the stand-by position in cooperation with the peripheral engaging part 19 of the resetting cam 18. At this time, a catch ledge 26a of each second engaging catch 26 is spaced apart from but facing convex unlocking ridges 37a through 37d for unlocking of an unlocking cam 37 described hereinafter. When the convex part 17b of each hammer head 17 is in sliding contact with the peripheral engaging part 19 of the resetting cam 18 and is thereafter engaged, a gap (of dimension X) as shown in FIG. 1 is formed between the recess 17c and the catch ledge 25a.

The engagement releasing mechanism comprises an electromagnet block 32 and the unlocking cam 37. The electromagnet block 32 comprises an L-shaped mounting plate 33 made of a metal sheet and five electromagnets 34 respectively for two columns (1 set) which are fixedly mounted on the mounting plate 33. The mounting plate 33 in turn is mounted on the aforementioned base 24 and secured thereto by screws 35. The outer end of the iron core 36 of each electromagnet 34 is facing in spaced-apart state a corresponding one of the aforedescribed armatures 31.

The unlocking cam 37 is formed to have four unlocking ridges 37a through 37d in its axial direction at equal intervals around its circumference as shown in FIGS. 1 and 2 and is driven in rotation synchronously with the aforedescribed resetting cam 18.

The aforementioned printing paper 38 is fed intermittently line-by-line upwardly between the type wheel 11 and the hammer heads 17 by a pair of paper feeding rolls 39 and 40 from below as viewed in FIG. 1.

By the above described mechanism, each electromagnet 34 is assigned the hammers 17 for two columns and causes them to successively undergo printing operation at time instants that are mutually different. For this reason, the peaks of the consumed electric power of all electromagnets 34 are reduced to ½. Accordingly, the components required for the electromagnet control circuit become inexpensive and require lower power, and, moreover, the space occupied by the electromagnets is reduced, while the related construction can be simplified. Furthermore, in the above described hammer block 14 and the engagement mechanism 21, single comb-like leaf springs 15 and 23 for all columns are respectively integrally mold formed with synthetic resin parts. For this reason, there are no deviations from column to column, and precision can be improved. Furthermore, the assembling time can be reduced.

The printing device 10 of the above described construction according to the present invention operates in the following manner. First, a motor (not shown) is started, and the above described printing device 10 and a control circuit 101 (not shown) are synchronized. Then, when a desired type 12 of a desired column of the type wheel 11 reaches its printing position 11a, this is detected through known technology by a detector 102 for detecting a timing signal responsive to the rotation of the type wheel 11 and a detector 103 for detecting a resetting signal responsively to the rotation of the resetting cam 18. The resulting detection signals of these detectors 102 and 103 are read by the control circuit 101, which operates in response to the signals introduced as input at an external signal input device 104 to pass current through the electromagnet corresponding to the above mentioned desired column.

The corresponding armature 31 thereupon is drawn toward the iron core 36 against the force of the spring part 22c, pivoting about its point of contact with the front edge of the mounting plate 33. Finally, the armature 31 contacts commonly the front ends of the mounting plate 33 and the iron core 36. In this case, a magnetic loop is formed by the armature 31, the iron core 36, and the mounting plate 33, and a powerful magnetic force due to this loop acts immediately before the attraction and contacting and after contacting of the armature 31. For this reason, the armature 31 and the second engaging catch 26, because of the small spring force of the spring part 22c and the action of the above mentioned magnetic loop, are displaced very quickly yet stably toward the right as viewed in FIGS. 1 and 4, and the catch ledge 26a is brought within the rotational path of the unlocking ridge 37a of the unlocking cam 37 as indicated by the single-dot chain line in FIG. 4. While the engaging catch 26 is in the state within the above mentioned rotational path, it is further held stably by the magnetic loop and causes the subsequent engagement action due to the unlocking cam 37 to be carried out smoothly.

Continuously thereafter, the unlocking cam 37 rotates in the arrow direction, and its ridge 37a also reaches the position indiciated by the single-dot chain line in FIG. 4 to contact and catch the above mentioned catch ledge 26a. As a consequence, the engaging catch 26 is then displaced downward as viewed in FIG. 4. During this action, the ridge 37a moves away obliquely downward, whereby the engaging catch 26, as it is released from the above mentioned engagement, reaches the maximum limiting position indicated by two-dot chain line in FIG. 4 under its inertia.

In accompaniment with the above mentioned downward displacement of the engaging catch 26 and the armature 31, the first engaging catch 25 undergoes a downward displacement as viewed in FIG. 1 counter to the spring force of the spring part 22 until it reaches the position indicated by the two-dot chain line in FIG. 1 and terminates the engagement with the recess 17c of the hammer heads 17 for two columns. Then the two hammer heads 17 at this time are in a state wherein they cannot rotate with their respective convex parts 17b respectively pressed against and in sliding contact with respective peripheral engaging parts 19 of the resetting cam 18.

When the resetting cam 18 successively rotates slightly in the arrow direction in FIG. 1, the convex part 17b of one of the hammer heads 17 of the desired column of the hammer heads 17 for the above mentioned two columns reaches the rotation permitting part of the recess 18a (or 18b) and then, under the spring force of its hammer spring 15a, rotates toward the left as viewed in FIG. 1 to reach the position indicated by two-dot chain line. As a result, the striking face 17a of the hammer head 17 stamps the printing paper 38 against the desired type 12 at the printing position 11a of the type wheel 11 thereby to carry out the desired printing.

At the time of the above described striking of the hammer head 17, the hammer spring 15a has passed by the spring neutral point and is deflected leftward as viewed in FIG. 1. For this reason, the hammer head 17 is caused by the spring force of the hammer spring 15*a* to start its return rotation toward the right as viewed in FIG. 1 and gain passes by the neutral point of the spring, but at this time, its convex part 17*b* is guided by the resetting part 20*b* of the resetting cam 18 under rotation to the succeeding peripheral engaging part 19. The hammer head 17 is thereby rotated in return motion to its original position.

On the other hand, the supply of energizing current through the aforedescribed electromagnet 34 is cut off during the downward movement of the catches 26 and 25 and the armature 31 due to the unlocking cam 37. As the unlocking cam 37 rotates, the engaging catch 26 of the spring part 22*c*, which has reached the position indicated by two-dot chain line in FIG. 4, is released from its engagement with the ridge 37*a* of the unlocking cam 37 and thereafter moves slightly downward under its momentum. Thereafter, the leaf spring part 22 is caused by the large spring force of the spring part 22*a* of the first engaging part 25 to rotate quickly upward in return motion. At the same time, the catch ledge 25*a* engages the recess 17*c* of the hammer head 18 for the desired column in a state wherein there is a gap X as described hereinbefore and is thus returned, the hammer head 17 having been returned to its original position after the above described printing operation.

After the engaging catch 26 has disengaged from the ridge 37*a* of the unlocking cam 37, it is forcibly caused by the quick rotational return motion of the spring part 22*a* to rotate and return, together with the armature 31, upward and toward the left as viewed in FIG. 1 in spite of the small spring force of its spring part 22*c*. For this reason, the engaging catch 26 does not remain within the rotational path of the succeeding ridge 37*d*, and there is no possibility of erroneous operation. Thus, the printing by one of the hammer heads 17 for the two columns corresponding to the above mentioned desired electromagnet 34 is completed.

Successively thereafter, in exactly the same manner as described above, the above mentioned electromagnet 34 is again energized, and the remaining hammer head 17 carries out printing of the other desired type 12 in the remaining column of the printing paper 38 interrelatedly with the other recess 18*b* (or 18*d*) of the unlocking cam 18.

In this manner, while the type wheel 11 rotates through one revolution, the resetting cam 18 and the unlocking cam 37 rotate through 8 revolutions thereby to complete the printing for the above mentioned two columns. Furthermore, during this operation, the other four electromagnets 34 are also respectively energized in the same manner, and the hammer heads 17 corresponding thereto carry out their respective printing. Thus, the printing of all columns is completed. Successively, the printing paper 38 is fed upward by the spacing of one line by the paper feed rolls 39 and 40, whereby the succeeding specific line reaches the printing position 11*a*. Even when, in the case where one electromagnet 34 successively operates continuously for two columns, the leaf spring part 22 which has operated first has not fully returned, this will have no deleterious effect whatsoever on the operation for the succeeding other column.

In accordance with the above described embodiment of the invention, in the leaf spring part 22 of the engagement mechanism 21, the first and second engaging catches 25 and 26 respectively have a locking and an armature function which are efficiently divided and shared. Mbreover, the spring part 22*c* having the armature function has a relatively small spring force and therefore can easily rotate. For this reason, even a weak exciting current of the order of, for example, 140 mA for the electromagnet 34 suffices, whereby the components of the control circuit can be made even less expensive. Furthermore, since the spring part 22*a* has a relatively large spring force, the rotational return motion of the above mentioned leaf spring part 22 becomes quick, the operations of locking and unlocking the hammer head 17 are speeded up. Thus, high-speed typing of the order of 2.5 lines per second, for example, becomes possible. In this connection, it is to be noted that, in spite of the great spring force possessed by the spring part 22*a*, it is forcibly rotated downward by the unlocking cam 37, whereby it does not give rise to an operational delay and does not hinder the above described high-speed printing.

When the engaging catch 26 is released from its engagement by the ridge 37*a* of the unlocking cam 37, as described hereinabove, and is caused to start its rotational return toward the left as viewed in FIG. 1, simultaneously, the armature 31 is also separated forcibly by the iron core 36 of the electromagnet 34. For this reason, a non-magnetic metal plate ordinarily fixed to the face of the iron core 36 for drawing the armature 31 for preventing residual magnetism becomes unnecessary, and the construction can be simplified by that much.

Furthermore, the rotation of the type wheel 11 through the angle for one character spacing pitch of a specific column is caused to correspond to ½ revolution of each of the resetting cam 18 and the unlocking cam 37 (ordinarily caused to correspond to one revolution in the prior art) thereby to reduce the rotational speed of these cams 18 and 37. For this reason, the abrasive wear and rotational noise due to the above mentioned engagement of particularly the ridges 37*a* and 37*d* of the unlocking cam 37 are reduced, and the mechanical life and performance of the printing device are improved.

In the above described embodiment of the invention, one set is constituted by two columns, but this ratio is not so limited, and one set may be made to correspond to three or more columns.

Furthermore, in the above described embodiment of the invention, the first and second engaging catches 25 and 26 are constructed integrally respectively with the spring parts 22*a* and 22*c*. However, the construction need not be so restricted. For example, a structural arrangement wherein each of the engaging catches 25 and 26 is pivotally supported on a specific pin and, at the same time, urged to rotate by a coil spring may be used.

Figure 6:
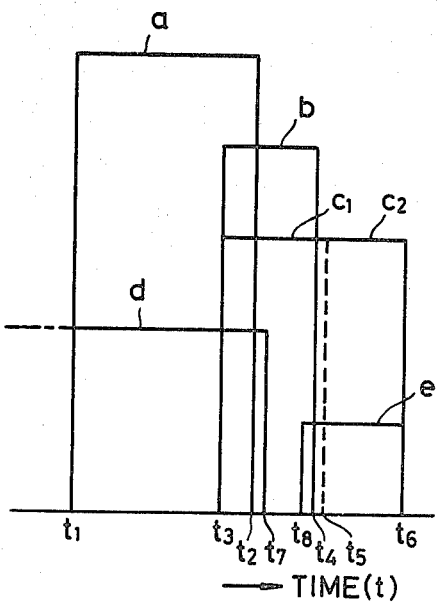
FIG. 6 is a time chart indicating the operational states of various moving parts in the same printing device.

The operations respectively of the hammer head 17, the resetting cam 18, the engaging catches 25 and 26, the electromagnet 34, and the unlocking cam 37 and the relationships between these operations in the above described embodiment of the invention are indicated by the time chart in FIG. 6. During the time interval t1 to t2 indicated by line a, the electromagnet 34 is supplied with an exciting current and thus energized. The engaging catch 26 is drawn by and toward the electromagnet 34 and is engaged with the unlocking cam 37 during the time interval t3 to t4 indicated by line b. The engaging catch 25 is released from its engagement with the hammer head 17 and, together with the above mentioned engaging catch 26, is displaced downward during the time interval t3 to t5 indicated by line c1 and, successively, is displaced upward during the time interval t5 to t6 indicated by line c2, thereby returning to its state of engagement with the hammer head 17.

Furthermore, after starting its downward displacement as described above at the time instant t3, the second engaging catch 26 disengages from the hammer head 17 at the instant t7 at the terminal end of line d. As a consequence, the hammer head 17 is preparatorily disengaged and once slidingly contacts the peripheral locking part 19 of the resetting cam 18 during the time interval t7 to t8. Thereafter, the hammer head 17 reaches the recess 18*a* (rotation permitting part 20*a*) and starts to rotate. After completion of its printing action, it rotates in return motion and is locked by the engaging catch 25 at the time instant t6. The time interval t8 to t6 is indicated by line e.

Accordingly, as indicated by the above described time chart of FIG. 6, even after the termination of the energization (t1 to t2) of the electromagnet 34, the engaging catch 26 is further foricbly engaged (t3 to t4) with the unlocking cam 37. Consequently, the engaging catch 25, at the time instant t7 after termination (time instant t2) of the exciting of the electromagnet 34, releases the hammer head 17.

In the time chart of FIG. 6, the time instant t7 of disengagement of the engaging catch 25 and the hammer head 17 and the time instant t8 at which the hammer head 17 starts to rotate are staggered in time. Alternatively, however, the device may be so adapted that, for example, at the time instant t7, the ridge 17*b* of the hammer head 17 is caused to confornt the rotation permitting part 20*a*, and, simultaneously with the above mentioned disengagement, the hammer head 17 starts to rotate, that is, that the time instants t7 and t8 coincide.

According to the time chart of FIG. 6, the time instant (t7) of disengagement of the engaging catch 25 and the hammer head 17 is after the time instant (t2) at which the exciting of the electromagnet 34 is terminated. At first glance, the length of the total period t1 to t6 would appear to be greater than in prior-art examples. Actually, however, the spring forces of the spring parts 22*a* and 22*c* of the spring device 22 are respectively set at large and small values thereby to shorten the intervals of lines c1 and c2 in FIG. 6 as described above. For this reason, the period t1 to t6 as a whole is shorter than in the prior-art examples, and the printing speed is increased.

It should be mentioned that the time chart of FIG. 6 is applicable also to printing devices 50 and 60 described hereinafter.

Next, certain problems associated with the above described printing device 10 will be considered. As described above, each hammer head 17 for carrying out printing is first released from the preparatory locking by the engaging catch 25. Thereafter, the hammer head 17 moves from the peripheral locking part 19 of the resetting cam 18 and reaches the rotation permitting part 20*a* thereof to be finally unlocked. The hammer head 17 thereby drops into the rotation permitting part 20*a* to carry out printing. During this operation, there is no mutual contact whatsoever between the hammer head 17 and the engaging catch 25, whereby the problem of noise due to physical contact does not arise.

Figure 5:
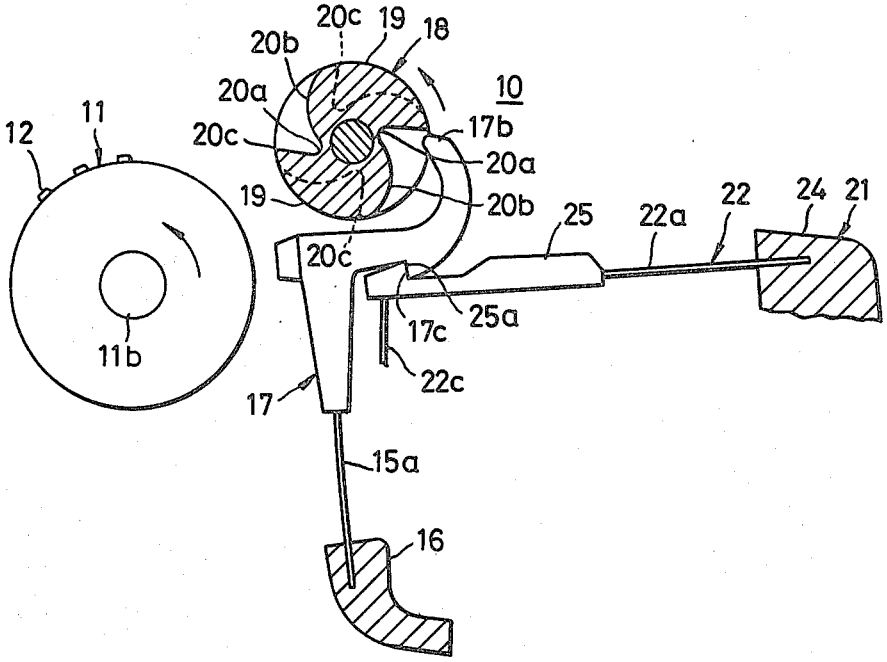
FIG. 5 is a side elevation, with parts cut away and parts shown in section, indicating the operational state of a hammer head accompanying the rotation of a resetting cam in the same printing device.

On the other hand, each of the hammer heads 17 which are not carrying out printing, when conforming to their respective peripheral engagement parts 19 of the resetting cam, is spaced apart from the catch ledge 25*a* with the gap X therebetween. However, since the extreme end 19*a* of the corresponding peripheral engagement part 19 at the time when the hammer head 17 moves to the rotation permitting part 20*a* in FIG. 1 is merely provided with a rounded contour of small radius of curvature, the hammer head 17 is caused by the force of the hammer spring 15*a* to rotate quickly toward the left as viewed in FIG. 1 until the above mentioned gap X becomes zero. The hammer head 17 thus reaches its position indicated in FIG. 5.

At this time, the hammer head 17 and the engaging catch 25 quickly contact each other, and the convex part 17*b* of the hammer head slips to some extent into the rotation permitting part 20*a* of recess 18*a*. Successively, the hammer head 17 is caused by the resetting part 20*b* of the recess 18*a* to return in conformance with the succeeding peripheral engaging part 19 and once again form the gap X between itself and the catch ledge 25*a*. Thus, each of the hammer heads 17 not carrying out printing quickly contacts the corresponding engaging catch 25 and thereby generates a considerably loud sound. Inaddition, each of the plurality of hammer heads 17 generates this sound at every character pitch of the type wheel 11 exclusive of only two instances of rotation for printing. Consequently, these sounds as a whole become a considerably loud continuous noise, which becomes a serious problem of environment at the time of operation.

Figure 7:
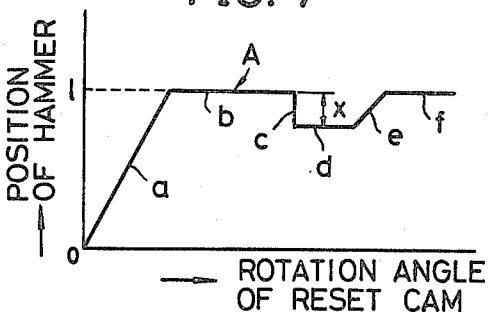
FIG. 7 is a graph indicating the relationship between the position of a hammer and the rotational angle of the resetting cam shown in FIG. 6.

The position in displacement of the above mentioned hammer head 17 relative to the rotational angular displacement of the above described resetting cam 18 is indicated in FIG. 7. In this graph, the distance at the time the hammer head strikes the type is made zero, and the distance at the time when the resetting cam 18 is in sliding contact with the peripheral engaging part 19 is denoted by l.

In FIG. 7, line a indicates the operation wherein the hammer head 17 is guided by the resetting part 20*b* of the resetting cam 18 and thus undergoes returning rotation after the printing operation. Line b indicates the state wherein the hammer head 17 is in sliding contact with the peripheral engaging part 19 and is thus held in the standby position. Line c indicates the movement wherein the aforementioned hammer head 17 which does not carry out printing rotates toward the type wheel 11 by a distance corresponding to the dimension of the gap X. Line d indicates the state wherein the hammer head 17 is stopped and held at the position to which it has rotated by the distance corresponding to the gap X by the contact between the recess 17*c* and the catch ledge 25*a*. Line e indicates the operation wherein the hammer head 17 is guided by its contact with the extreme end of the resetting part 20*b* of the resetting cam 18 and thus reaches the succeeding peripheral engaging part 19. Line f indicates the state wherein the hammer head 17 is again held in the stand-by position by the above mentioned succeeding peripheral engaging part 19. In FIG. 7, the vertical orientation of the line c indicates the quick rotation of the hammer 17 and accompanying generation of noise.

Figure 8:
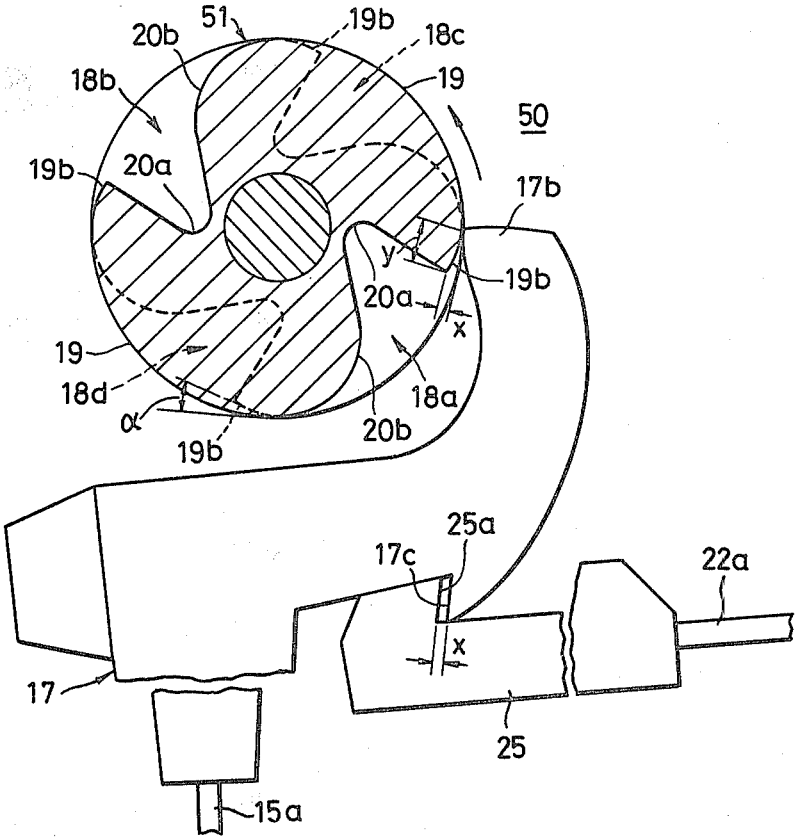
FIG. 8 is a relatively enlarged, fragmentary side elevation, with parts cut away and parts shown in section, of an essential part of a second embodiment of the printing device according to the invention.
Figure 9:
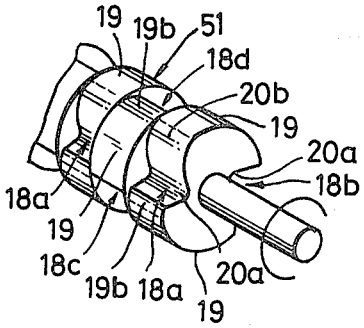
FIG. 9 is a fragmentary perspective view of a resetting cam in the device shown in FIG. 8.

The problem of the above mentioned generation of noise has been solved in the printing device generally designated by reference numeral 50 in FIG. 8. In FIG. 8, those parts which are the same as corresponding parts in FIG. 1 are designated by like reference numerals and subscripts. Description of such parts will not be repeated.

In this printing device 50 illustrated in FIG. 8, a resetting cam 51 is generally of the same construction as the aforedescribed resetting cam 18. Each peripheral engaging part 19 is provided at its extreme end and in the vicinity thereof with a clearance or relief guide part 19*b*. Each relief guide part 19*b* has a shape, as viewed in cross section of the resetting cam 51, wherein its profile line diverges inward and away from the circumscribing circle of the resetting cam 51, starting from a starting point at a distance y from the extreme end, and generally forms an angle $\alpha$ with the tangent to that circle at that starting point, the profile line dipping toward the axis of the cam 51 to a terminal point at a distance z inward from the circumscribing circle. The distance y is selected to leave some part of the peripheral engaging part 19 along the circumscribing circle. The distance z is selected at a value of the order of 4/3 times the maximum value of the aforementioned gap x between the engagement ledges 17*c* and 25*a*.

By the provision of these relief guide parts 19*b*, the engaging catch 25 is maintained in its position as it is without rotating downward as viewed in FIG. 8 when the corresponding hammer head 17 does not carry out printing. Furthermore, the convex part 17*b* of the hammer head 17 undergoes sliding contact with the peripheral engaging part 19 of the resetting cam 51 in rotation and successively moves onto the relief guide part 19*b*. The convex part 17*b* is thereby guided by the relief guide part 19*b* and thus moves leftward as viewed in FIG. 8. Consequently, the hammer head 17 is successively rotated in the counterclockwise direction through a small angle, and the gap X between the recess ledge 17*c* and the catch ledge 25*a* is also gradually reduced.

Then, when the above mentioned convex part 17*b* reaches the extreme end of the relief guide part 19*b* or a point in the vicinity thereof, the above mentioned gap X becomes zero. As a consequence, the hammer head 17 gently contacts the first engaging catch 25, and is thus locked, thereafter being stopped from rotating further in the clockwise direction. The resetting cam 51 continues to rotates, and the convex part 17*b* separates away from the relief guide part 19*b* and moves to a position corresponding to the rotation permitting part 20*a*. Consequently, the hammer head 17 is held in the position at which it has been locked by the first engaging catch 25 until it contacts a point in the vicinity of the extreme end of the succeeding resetting part 20*b*. The operation thereafter is exactly the same as that in the previously described printing device 10 illustrated in FIG. 1.

Thus, according to the above described construction, the hammer head 17, after carrying out printing, is finally locked by only the engaging catch 25 similarly as in the case of the printing device described hereinbefore. In the present case, however, the contact with the catch ledge 25*a* is accomplished in a shock-absorbing manner because of the effect of the relief guide part 19*b*, whereby undesirable noise is not generated.

In the above described construction, the recess 17*c* or the catch ledge 25*a* may be provided on its contact surface with a rubber sheet or a damper layer deposited by a method such as rubber spraying (the gap X being provided as before). By the provision of such a cushioning layer, the shock-absorbing contact action of the relief guide part 19*b* is made even more effective.

Figure 10:
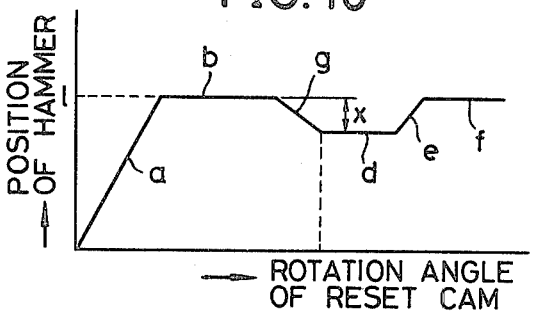
FIG. 10 is a graph indicating the relationship between the position of a hammer and the rotational angle of the resetting cam in the device shown in FIG. 8.

FIG. 10 is a graph indicating the position in displacement of the hammer head 17 relative to the rotational angle displacement of the resetting cam 51. In this FIG. 10, those parts which are the same as corresponding parts in FIG. 7 are designated by like reference characters. Description of such parts will not be repeated. In FIG. 7, the line c is vertical, which indicates a quick rotation of the hammer head 17, that is, the generation of noise, but in FIG. 10, the line g, is inclined, which indicates a gentle rotation of the hammer head 17, that is, that noise is not generated.

In the printing devices 10 and 50 of the above construction, the total angular range over which the hammer heads 17 make pressing and sliding contact with the outer peripheral engaging parts 19 of the resetting cam structures 18 and 51 per revolution thereof reaches substantially 180 degress. In such structure, therefore, if the force for displacing the hammer heads 17 is increased to obtain a sufficient printing pressure, the rotational frictional force developed between the resetting cam structure 51 and the hammer head 17 becomes rather large, and the motor therefore requires large electric current for rotatingly driving the resetting cam structures 18 and 51. This gives rise to disadvantages such that the printing device 10 described above is difficult to apply to a printing apparatus intended to consume less electric power or one intended to use power cells as the power source.

FIGS. 11 through 14 show a printing device 60 which attain some reduction of the power consumption in dirving the resetting cam structures, thus making it possible to overcome the above described disadvantages. In FIGS. 11 through 14, those parts which are the same as corresponding parts in FIG. 1 are designated by like reference numerals. Detailed description of such parts will be omitted.

Figure 11:
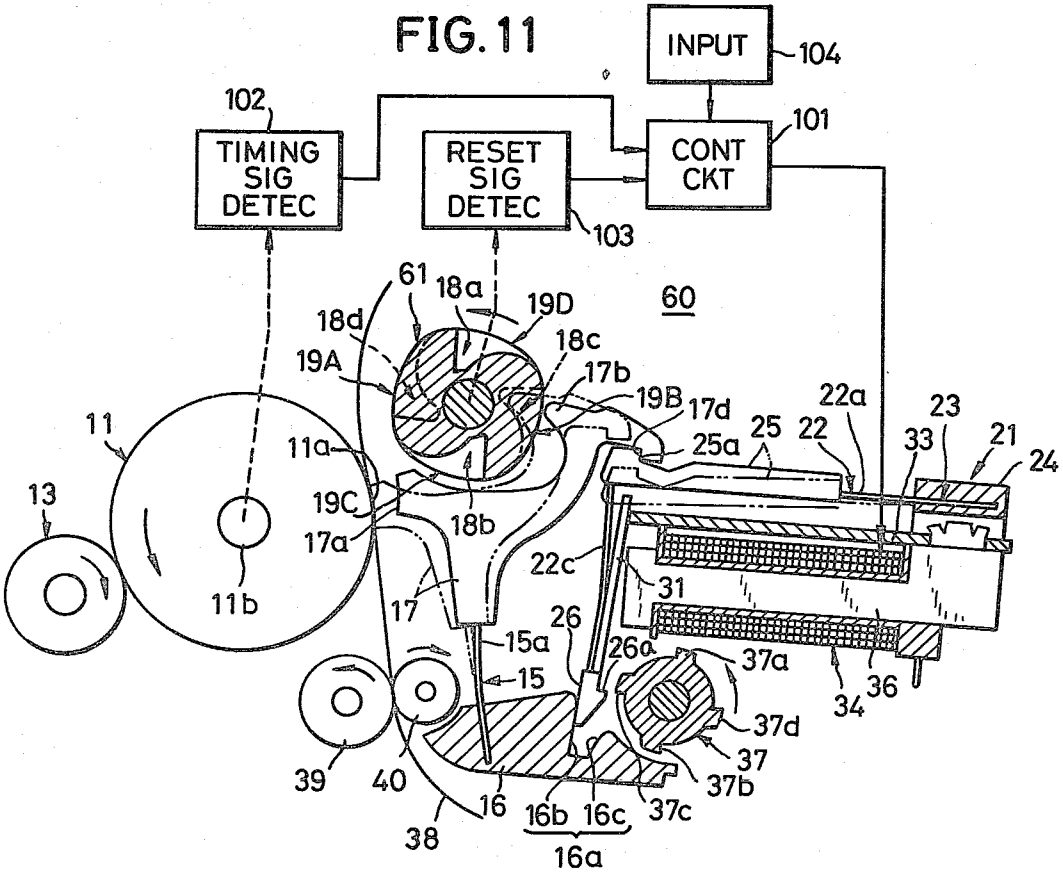
FIG. 11 is a side elevation, with parts cut away and parts in section, of a third embodiment of the printing device according to the invention.
Figure 14:
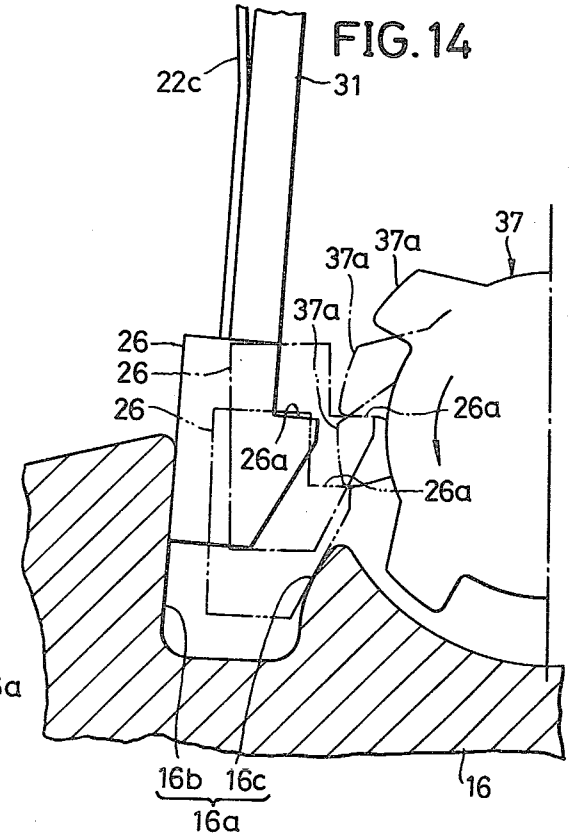
FIG. 14 is an enlarged, fragmentary side elevation indicating the engagement action of a second engagement part and an unlocking cam of an engagement member in the same printing device shown in FIG. 11.
Figure 12:
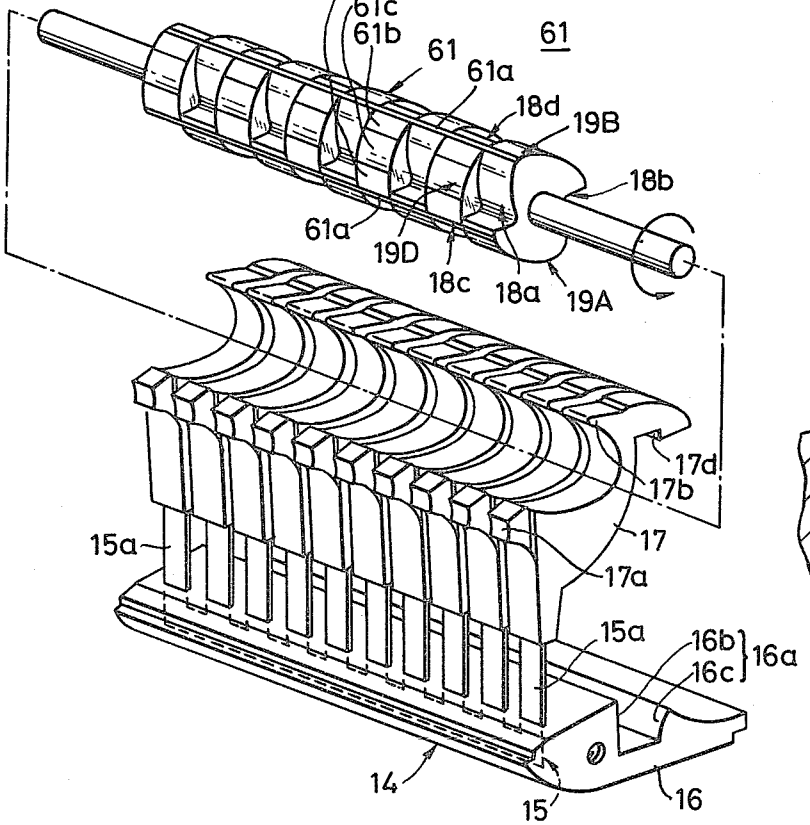
FIG. 12 is a perspective view showing a hammer block and a resetting cam of the printing device illustrated in FIG. 11.

Referring to FIGS. 11 and 12, each hammer head 17 has a recess 17*d*, which is disposed more in the vicinity of the top of the hammer head 17 than the recess 17*c* in the hammer head 17 indicated in FIGS. 1 and 8. In this connection, the first engaging catch 25, the electromagnet 34, and the unlocking cam 37 are disposed in an upwardly shifted position, and the parts, such as the base 16, are arranged more efficiently in terms of space, thus making it possible to reduce the overall height and to miniaturize the printing device.

Moreover, the recess 17*d* is disposed at a position more apart than the recess 17*c* in the above described printing devices 10 and 50 from the rotational center of the hammer head 17. In such arrangement, when the curved convex part 17*b* of the hammer head 17 is caused to undergo oscillatory motion over a distance (U—V) responsive to the rotation of the resetting cam structure 61, as will described further below, (at this time, the gap X between the recess 17*d* and the catch ledge 25*a* varies over a specific distance, that is, from zero to (U—V), the range of the rotational angle of the hammer head 17 is correspondingly reduced. The range over which the spring force of the leaf spring 15*a* varies is further narrowed. Therefore, coupled with the fact that the curved convex part 17*b* faces, in spaced-apart relationship, an associated small-diametral peripheral part 61*c* of the resetting cam structure 61 almost all the time, both the noise level and the amount of current required for the motor are reduced more effectively.

Figure 13:
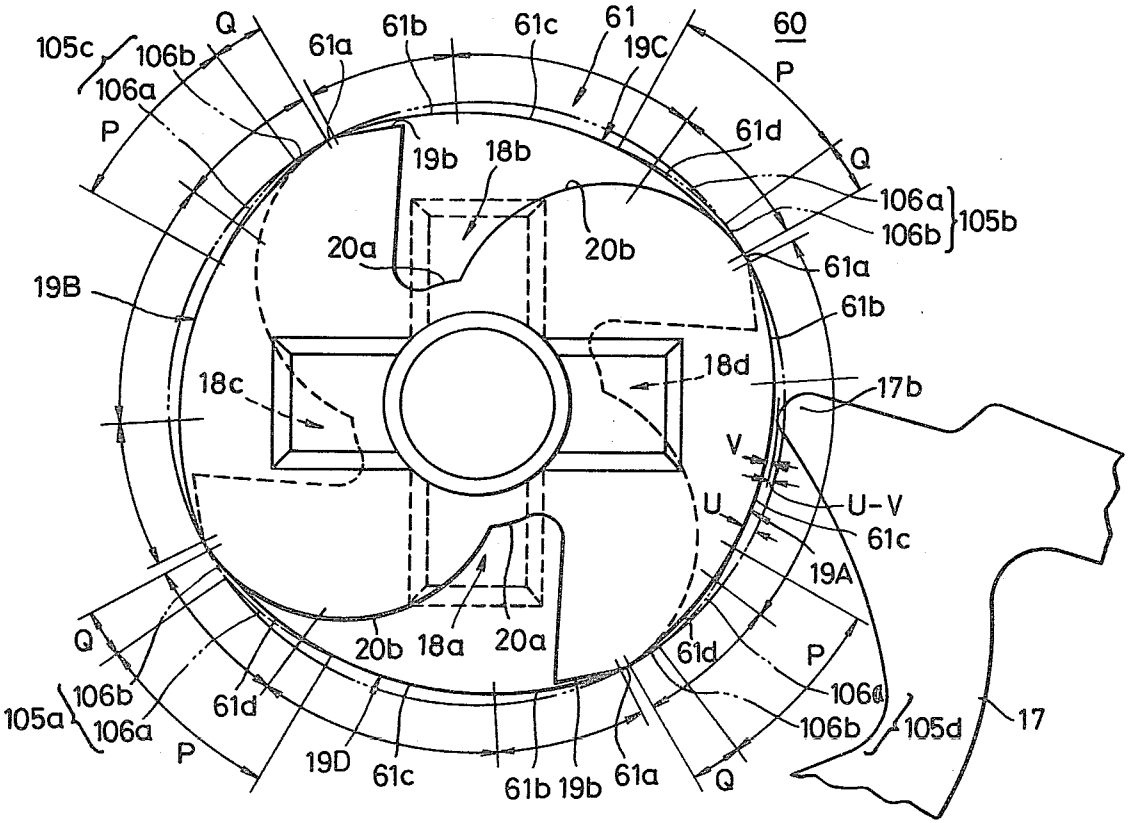
FIG. 13 is an enlarged, fragmentary side elevation indicating the mechanical relationship between a resetting cam and a hammer part of the printing device shown in FIG. 11.

The resetting cam structure 61, as indicated in FIG. 13, is formed with the relief guide parts 19*b* near the end of each of the outer peripheral engaging part 19, as in the resetting cam structures 11 and 51. Four outer peripheral engaging parts 19 (19A, 19B, 19C and 19D), which are spaced at equal angular intervals, are respectively defined of configuration by four successive parts, namely, a large-diametral peripheral part 61*a* of narrow width in the circumferential direction, a guide part 61*b* extending with the radius thereof progressively reduced, a small-diametral peripheral part 61*c*, and a guide part 61*d* extending to the following large-diametral peripheral part 61*a*. The large-diametral peripheral part 61*a* is shifted in the radial direction from the small diametral peripheral part 61*c* by the distance U.

The hammer head 17 is engaged by the first catch ledge 25 in a manner such that the convex part 17*b* thereof confronts the small-diametral peripheral part 61*c* of the outer outer peripheral engaging part 19A, for example, of the resetting cam structure 61 while leaving a gap of a specific magnitude V therebetween (where, V is smaller than U, that is, $V<U$, and is about 0.05 mm to 0.2 mm). In such a state, the gap distance X between the recess 17*d* and the catch ledge 25*a* assumes zero.

In the present embodiment, the hammer head 17 is supported above the base 16 in such a manner that, when the leaf spring 15 assumes its neutral state, the striking face 17*a* is in substantial contact with the surface of associated type 12 around the type wheel 11, as indicated in FIG. 11. Therefore, when the hammer head 17 is spaced apart from the resetting cam structure 61 by the distance V, the leaf spring 15 is resultingly deflected toward the right as viewed in the same figure.

The catch ledge 26*a* of the second engaging catch 26 is accommodated within the recess 16*a* of the base 16 and is in contact with the contact surface 16*b*, thus facing, but spaced apart from, one of the unlocking ridges 37*a* through 37*d* of the unlocking cam 37.

Next, a description is given of the operation of the printing device 60 of the above construction. When the electromagnet 34 is energized, the associated armature 31 is attracted to the iron core 36 to undergo rotational movement rightwards as viewed in FIG. 11. The armature 31 thus rotated in then pushed down by the unlocking cam 37. The first engaging catch 25 thereby moves downwards as viewed in the same figure, and the recess 17*d* is released from its locked state as described later.

During the above operation, the hammer head 17 reaches the following state. That is, due to the rotation of the resetting cam structure 61, the convex part 17*b* of one hammer head 17 for a desired digit among two-digit hammer heads 17 is engaged by approacing guide part 61*d* and is guided thereby with less shock, and rides up the succeeding large-diametral peripheral part 61*a*. At this moment, the specific small gap ($X=U-V$) is temporarily formed between the recess 17*d* and the catch ledge 25*a*. This gap X is provided to assure that, when the other hammer head 17 enters into the recess 18*d* corresponding to the outer peripheral engaging part 19 and carries out printing action, the other hammer head 17 is caused to return to be locked by the engaging catch 25. Then, the hammer head 17 for the desired digit is guided at the convex part 17*a* thereof by the relief guide part 19*b* of the following recess 18*a*, thereby to move gradually inward, thus being brought into contact engagement between the recess 17*d* and the engaging catch 25. This engagement action is carried out with less shock and noise, similar to the above described printing device 50.

At this moment, as in the preceding case, the printing signal is delivered to release engagement between the recess 17*d* and the catch ledge 25*a*. Following this, the rotating resetting cam structure 61 further rotates by a small amount in the direction indicated by an arrow in FIG. 13, and the rotation permitting part 20*a* in the recess 18*a* comes to confront the convex part 17*b* of the hammer head 17 for the desired digit. The hammer head 17, thereupon, moves rotationally to the left as viewed in FIG. 11 due to the accummulated spring force of the deflected leaf spring part 15*a* itself and reaches the position indicated by the two-dot chain lines, where the leaf spring part 15*a* assumes its neutral state. The striking face 17*a* of the hammer head 17 strikes the desired type 12 located at a printing position 11*a* around the type wheel 11, thus carrying out the desired printing action.

The hammer head 17 bounces backward due to shock which occurs when the striking face 17*a* strikes against the type 12, and starts to return rightwards in FIG. 11. The convex part 17*b* bounced backward is then engaged and guided by the resetting part 20*b* of the recess 18*a* in the resetting cam structure 61 to the position where it rides up the succeeding outer peripheral part 19B, whereby the hammer head 17 is progressively restored to its original position.

In the above described operation of one sequence, of the whole outer peripheral part of the resetting cam structure 61, each hammer head 17 makes pressing contact with only the outermost peripheral part 61*a* which is of narrow width, and a part of the guide parts 61*b* and 61*d*. In the other mode of operation, which accounts for a substantial part of time of one sequence, the hammer head 17 faces, but is spaced apart from, the small-diametral peripheral part 61*c*. Therefore, the resetting cam structure 61 has little friction force exerted thereon, and requires less force for driving it to rotate. The rated current for the motor, therefore, can be reduced greatly. In practical application, the current for the motor in the printing device 60 in this idling mode can be reduced to around 250 mA, compared with 400 mA in the printing devices 10 and 50.

According to the embodiment described above, among the hammer heads 17 of plural digits, the hammer head 17 which has completed the printing operation is guided by the resetting part 20*b* and rides up the large-diametral peripheral part 61*a*, and the other hammer head 17 which does not carry out the printing operation is guided by the resetting part 61*d* and rides up the large diametral peripheral part 61*a*. Specifically, the convex parts 17*b* of hammer heads 17 of all digits come to ride up the large diametral peripheral parts 61*a* simultaneously. This gives rise to another undesired problem in that the current to the motor for driving the resetting cam structure 61 reaches its peak value temporarily when the above riding-up operation takes place. This problem can be solved by modifying the contour of each guide part 61*d* of the resetting cam structure 61 to the contour indicated by the two-dot chain line in FIG. 13. These modified guide parts 105*a* through 105*d* have their contour lines equal to each other, and are respectively defined by guide parts 106*a* extending over an angular range P, and large-diametral peripheral parts 106*b* extending over an angular range Q. The large-diametral peripheral parts 106*b* are substantially extensions of the large diametral peripheral part 61*a*.

With this resetting cam structure 61 having the guide parts 105*a* through 105*d*, the hammer head 17 which is retained at stand-by position is engaged and guided by the guide part 106*a* and then, before the instant when the hammer head 17 which has carried out printing operation rides on the large-diametral peripheral part 61*a*, rides on the large-diametral peripheral part 106*b*.

That is, there exists a time lag between the hammer head 17 which has carried out the printing operation and the other hammer head 17 which does not carry out the printing operation, in terms of the instant when they ride on their associated large-diametral peripheral parts. In such arrangement, it becomes possible to eliminate peak driving electric current and thereby to carry out operation in a satisfactory manner.

Further, this invention is not limited to these embodiments but various variations and modifications may be made without departing from the scope of the invention.

What is claimed is:

1. A hammer lock releasing mechanism for a printing device comprising:

(a) a rotary type wheel provided on its outer surface with a plurality of types disposed in the circumferential direction at equal angular intervals, and driven in rotation at a specific speed;

(b) a plurality of printing hammer heads disposed confronting said type wheel and undergoing displacement, during a printing operation, to selectively strike a desired type onto a sheet of paper, thereby carrying out printing, said sheet of paper being fed between said hammer heads and said rotary type wheel, each of said hammer heads having a convex part;

(c) a plurality of first urging means for constantly urging said hammer heads to move in the direction of carrying out a printing action, each of said first urging means being attached to one of said hammer heads;

(d) a plurality of locking means for locking said hammer heads in a non-printing position, each of said locking means being engageable with a plurality of said hammer heads, thereby preventing said first urging means from discharging their urging force, each of said locking means being attached to one of a plurality of second uring means;

(e) trigger means for displacing said locking means against a force exerted by said second urging means, so as to unlock said hammer heads and permit said hammer heads to carry out said printing action; and (f) a rotary cam structure rotatable in correspondence with the rotation of said type wheel and engageable by said convex parts of said hammer heads, said rotary cam struoture having a circumferential surface comprising a plurality of sequences of connected portions, each sequence comprising a portion for permitting the corresponding one of said hammer heads to carry out said printing action, a portion for resetting the corresponding one of said hammer heads connected to said portion for permitting said printing action, first and second peripheral portions of equal radius for holding the corresponding one of said hammer heads in a non-printing position, and an intermediate portion having a radius smaller than the radius of and lying between said first and second peripheral portions, said first peripheral portion and said portion for resetting the corresponding one of said hammer heads being connected in a continuous manner, and said second peripheral portion being connected in a discontinuous manner to an ajdacent portion for permitting said printing action, wherein (i) said portion for permitting said printing action comprises a concave part for permitting said convex part of the corresponding one of said hammer heads, which is unlocked from the non-printing position by said trigger means, to enter therein, thereby permitting said hammer head to rotate under the influence of the corresponding one of said first urging means;

(ii) said portion for resetting the corresponding one of said hammer heads comprises a continuous surface of increasing radius for guiding said hammer head in a direction opposite the direction taken by said hammer head during said printing action so that the corresponding one of said locking means is engageable with said hammer head;

(iii) said first and second peripheral portions comprise surfaces of maximum radius on said rotary cam structure, said maximum radius being such that the corresponding one of said hammer heads is displaced from engagement with said locking means in response to said convex part of said hammer head contacting either of said peripheral portions; and (iv) said intermediate portion comprises a noncontact portion having a radius less than said maximum radius, such that said convex part of the corresponding one of said hammer heads is not in contact with said noncontact portion when said hammer head is locked by the corresponding one of said locking means.

2. A hammer lock releasing mechanism for a printing device as claimed in claim 1, wherein said circumferential surface of said rotary cam structure further comprises a relief guide portion connected in a continuous manner to said second peripheral portion and in a discontinuous manner to an adjacent portion for permitting said printing action, said relief guide portion having a radius that decreases toward said discontinuity.

3. A hammer lock releasing mechanism for a printing device as claimed in claim 1, wherein said plurality of sequences of connected portions forming the surface of said rotary cam structure alternatingly comprise first and second sets, said first and second sets of sequences being mutually staggered in phase by a predetermined angle.

4. A hammer lock releasing mechanism for a printing device as claimed in claim 1, wherein said plurality of types disposed on said rotary type wheel are arranged alternatingly in first and second sets of character columns, said characters in said first and second sets of character columns being mutually staggered in pitch in the circumferential direction by the distance of one character.

5. A hammer lock releasing mechanism for a printing device as claimed in claim 4, wherein each of said plurality of character columns on said rotary type wheel, each of said plurality of sequences of connected portions forming the surface of said rotary cam structure, and each of said plurality of hammer heads correspond to one of a plurality of digits.

6. A hammer lock releasing mechanism for a printing device as claimed in claim 3, wherein each pair of adjacent hammer heads corresponding to sequences of connected portions from said first and second sets respectively is engageable with one of said locking means, each of said adjacent hammer heads engaging the corresponding one of said first peripheral portions at times separated by a predetermined interval.

* * * * *